United States Patent [19]

Dieffenbach et al.

[11] Patent Number: 4,517,630

[45] Date of Patent: May 14, 1985

[54] MOTOR VEHICLE HEADLIGHT WITH CONDENSING LENS AND DIAPHRAGM

[75] Inventors: Rüdiger Dieffenbach; Werner Grünwald, both of Gerlingen; Peter Perthus; Friedrich Prinzhausen, both of Stuttgart, all of Fed. Rep. of Germany

[73] Assignee: Robert Bosch GmbH, Stuttgart, Fed. Rep. of Germany

[21] Appl. No.: 445,430

[22] Filed: Nov. 30, 1982

[30] Foreign Application Priority Data

Dec. 8, 1981 [DE] Fed. Rep. of Germany ..... 3148432
Jul. 16, 1982 [DE] Fed. Rep. of Germany ..... 3226580

[51] Int. Cl.[3] ..... F21V 5/00

[52] U.S. Cl. ..... 362/268; 362/80; 362/83; 362/309; 362/328; 362/310; 362/329; 362/339; 362/331; 362/337; 362/347; 362/350

[58] Field of Search ..... 362/61, 80, 296, 297, 362/308, 310, 328, 329, 331, 332, 337, 339, 346, 347, 350, 268, 83; 315/82

[56] References Cited

U.S. PATENT DOCUMENTS

| | | | |
|---|---|---|---|
| 1,393,573 | 10/1921 | Ritter | 362/339 X |
| 1,758,041 | 5/1930 | Heyman | 362/350 |
| 1,871,629 | 8/1932 | McMenamin | 362/347 X |
| 2,647,203 | 7/1953 | Smith | 362/350 |
| 3,377,479 | 4/1968 | Schreiber | 362/309 X |
| 3,745,325 | 7/1973 | Harvey | 362/346 X |
| 3,955,077 | 5/1976 | Jones et al. | 362/297 X |
| 4,066,887 | 1/1978 | Levis | 362/346 X |
| 4,209,825 | 6/1980 | Shackelford | 362/328 X |
| 4,246,631 | 1/1981 | Draper et al. | 362/347 X |
| 4,305,119 | 12/1981 | Draper et al. | 362/335 X |

FOREIGN PATENT DOCUMENTS

| | | | |
|---|---|---|---|
| 2385977 | 12/1978 | France | 362/331 |

*Primary Examiner*—Peter A. Nelson
*Attorney, Agent, or Firm*—Frishauf, Holtz, Goodman & Woodward

[57] ABSTRACT

The optic axis of a vehicle headlight comprises a reflector, an incandescent helix and a convergent lens. The reflection surface of the reflector is parabolic in the horizontal midplane section and is elliptical in vertical median section. A narrow band of light spreading out laterally is thus produced without supplementary optical components, particularly the diffusion disk or dispersion lens. A sharp light-to-dark boundary is obtained by a diaphragm having an effective straight edge 18 located below the outer ellipse focus, which is coincident with that one of the principal foci of the converging lens which is the nearer to the reflector.

11 Claims, 9 Drawing Figures

MOTOR VEHICLE HEADLIGHT WITH CONDENSING LENS AND DIAPHRAGM

This invention concerns a headlight for a motor vehicle having a reflector of which at least the vertical profile is an ellipse at the focus of which, within the reflector the filament is located, while the outer focus is at the nearer focus of a convergent lens. Such a headlight is known in which the reflector part is an ellipsoidal surface of revolution, so that both the horizontal and vertical sections of the reflector surface are elliptical. The raw light beam proceeding outward from the convergent lens, unaffected by a diffusion disk, is there formed from essentially converging rays, so that when the beam is examined on a measuring screen (compare FIG. 3) a light spot of the shape of a circular disk appears around the point identified as HV in FIG. 3.

In order to utilize such a raw light beam for a dimmed or stopped down headlight or fog light, optically effective means are required on the diffusion disk covering the reflector by which a horizontally diverging beam illuminates the roadway. In addition, still other optical means are needed to reinforce the portion of the beam that illuminates the roadway foreground.

SUMMARY OF THE INVENTION

It is an object of the present invention to simplify the optical system of a vehicle headlight meeting the requirements of not dazzling a driver coming in the opposite direction and at the same time providing the necessary illumination of the roadway, including the foreground and the edges of the roadway.

The horizontal profile of the reflector is preferably parabolic but in general it may be of any conic section type such that the curves described by the intersection of planes perpendicular to the axis of the reflector are ellipses of which the half-axes are perendicular to the axis of the reflector and one of these half-axes lies in the horizontal or median plane. With the headlights of the invention the raw lightbeam is already fanned out laterally as a horizontal ribbon of light without optical means at the diffusion disk. The invention proceeds on the basis that the light rays sent out parallel to the reflector axis from the paraboloidal reflector portion are spread out horizontally beyond the focus of the converging lens which is the second focus thereof in the exit direction of the lightbeam. It is furthermore advantageous to provide the optically effective edge of a stopdown diaphragm slightly below the common focus of the ellipsoidal portion of the reflector and of the converging lens in order to utilize fully the light flux of the reflector and to provide a sharp light-to-dark boundary. It is useful for the focal length of the converging lens to be a different values for different radial zones and for them to have a common focus, since this spreads out the light distribution horizontally, magnifying the horizontal divergence of the lightbeam. This can be further improved if the focal length of the converging lens diminishes towards its edge.

In a modified form of the invention a supplementary converging lens is provided that may be of annular form or may be composed of two lateral sectors or two lateral circular surface sections in mirror image relation.

Headlights with a high width-to-heighth ratio are favored for good fitting into modern vehicle bodies. In such cases the width is most commonly twice the height. In the case ellipsoidal reflector headlights or parabolellipsoidal reflector headlights, the reflector shape is to a great extent determined by the required light values. This objective is met, however, with the present invention by the provision of a supplementary converging lens constituted as a Fresnel lens. The height of the headlight and hence the height of the light beam can be further reduced when the focal length of the converging lens proper is smaller than the focal length of the supplementary converging lens.

In the case of headlights for dimmed or stopped down light the light beam portion projected from the lower reflector half is screened off by the diaphragm and is thus not available for the contribution to the dimmed or stopped down light beam. In accordance with the invention, however, the converging lens may consist of an upper half and a lower half having different focal lengths, the focal length of the lower half being greater than that of the upper half by an amount equal to the distance between the ends of the filament at the interior focus of the reflector as measured parallel to the optic axis, in which case it is desirable for the filament helix to have its length in the direction of the optic axis. With this arrangement a part of the screened off light beam section is drawn upon to provide better illumination below the light/dark boundary. Finally, the headlight of the invention is less sensitive with respect to large tolerances of the filament or lightbulb and the useable light flux from the reflector is greater.

BRIEF DESCRIPTION OF THE DRAWINGS

The invention is further described by way of illustrative example with reference to the annexed drawings, in which.

DESCRIPTION OF THE ILLUSTRATED EMBODIMENTS

Figure 1:
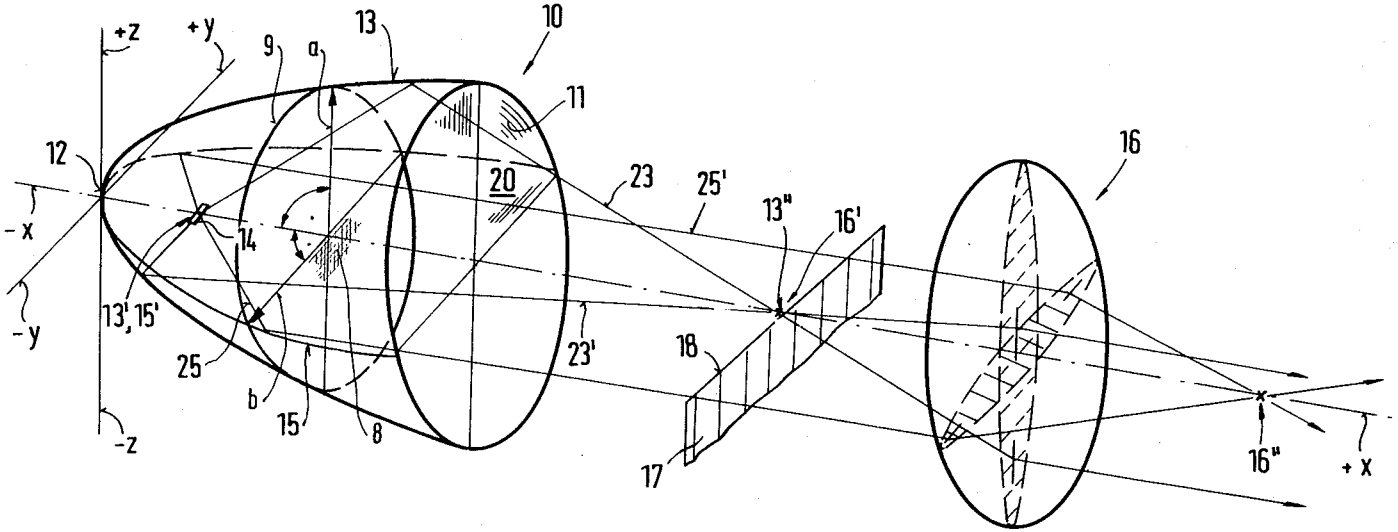
FIG. 1 is a perspective representation of a headlight system having a reflector, diaphragm, and converging lens.

The vehicle headlight shown in perspective in FIG. 1 has a reflector 10 with a reflector surface 11 and a vertex 12. At the latter is the origin of a coordinate system that is drawn into the figure showing the X-axis, Y-axis and Z-axis. The vertical median section 13 is approximately a half of an ellipse of which one focus 13' is near the vertex 12 while the other outer focus 13'', like the one first mentioned, lies on the X-axis. A transversely horizontal incandescent filament helix 14 is centered on the focus 13' with its length extending perpendicularly to the X-axis. The horizontal median section 15 is approximately a parabola the focus of which is not shown in the drawing as such and lies on the X-axis. It can well be designed to fall at the same point as the inner focus 13' of the elliptical vertical section of the reflector.

A biconvex converging lens 16 is disposed in such a way that its focal plane which faces the reflector 10 contains the outer focus 13'' of the reflector, the latter being coincident with one focus 16' of the convergent lens 16 lying in the aforementioned focal plane. The second focus 16'' of the converging lens 16 lies on the light opening of the headlight and on the X-axis.

A diaphragm 17 is disposed in the focal plane of the converging lens 16 facing the reflector 10 and below the X-axis of that reflector. The operating edge 18 of the diaphragm 17 lies slightly below the focus 16' of the converging lens 16. The word "focus" is used herein to mean a principal focus or focal point, which is the primary meaning of the word.

The reflection surface of the reflector 10 illustrated in FIG. 1 is described by the following equation:

$$\frac{y^2}{4f_p x} + \frac{z^2}{(2af_E - f_E^2)\left(\frac{2x}{a} - \frac{x^2}{a^2}\right)} = 1$$

The shape of the intersection of said reflecting surface by the horizontal median plane (15) of said reflector (10) is a conic section curve such that curves defined by intersection of a plane (8) perpendicular to the X-axis of the reflector (10) with said reflection surface (11) are ellipes (9) having their half-axes (a', b') perpendicular to said X-axis, one of said half-axes (b') lying in said horizontal median plane (20).

Four boundary rays radiated out from the incandescent spiral 14 are shown in FIG. 1 for symbolizing the raw light beam produced in the system. The two rays 23 and 23' are reflected from the elliptical region of the reflection surface 11 of the reflector 10 through the focus 13'' and are directed parallel to the X-axis in the principal plane of the converging lens 16. The two rays 25 and 25', on the other hand, are reflected parallel to the X-axis by the parabolic section of the reflection surface 11 of the reflector 10 and are converged in the principal plane of the converging lens 16 so as to pass through the focus 16' of the latter, after which they spread out in horizontal directions. The diaphragm 17 blocks those reflective rays of the reflections surface 11 which could dazzle oncoming traffic.

Figure 2:
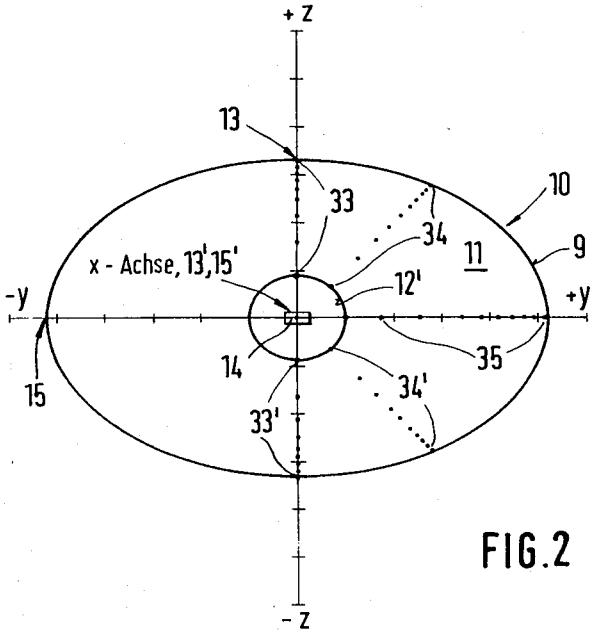
FIG. 2 is a front view of the reflector of FIG. 1 with four series of surface elements represented as points on the reflection surface.

The front view of the reflector 10 shown in FIG. 2, the hole 12' in the vertex of the reflector, the foci 13' and 15' of the ellipse and parabola lying in the optic axis and the reflection surface 11, along with five series of surface elements 33, 33'; 34, 34' and 35, each row having ten surface elements shown as points, of which only the two outer ones are designated in each case with reference numerals.

Figure 3:
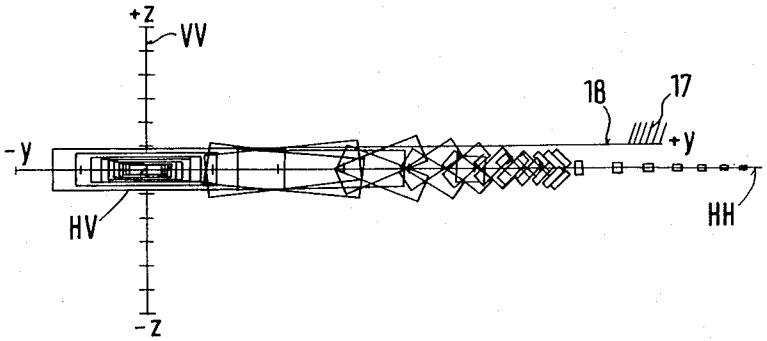
FIG. 3 shows in the form of a section a measuring screen with the filament images corresponding to the surface elements in FIG. 2.

FIG. 3 shows a measuring screen with a vertical line VV and a horizontal line HH, both crossing in the point HV. The measuring screen stands about 10 meters in front of the headlight in such way, that the X-axis is directed to the point HV. The edge 18 of the diaphragm 17, that is merely indicated generally and identified at the right of the drawing, lies above the line HH.

The surface elements 33, 33'–35 of FIG. 2 produce filament helix images in the form of rectangles of different sizes. At the HV point the helix images produced by the surface elements 33 and 33' are concentrated. The helix images 35 are the ones that lie farthest from the HV point. The surface elements 34, 34' produce the obliquely lying helix images. The helix images produce a horizontal band of light approximately 4° high.

The optical axis 19 of the entire imaging system consisting of the reflector 10 and the convergent lens 16 is inclined by about 2° downwards with reference to the X-axis of the coordinate system about the origin of coordinates. As can be seen from FIG. 3, the diaphragm would screen off only an outer corner of each of the obliquely lying helix images.

Figure 4:
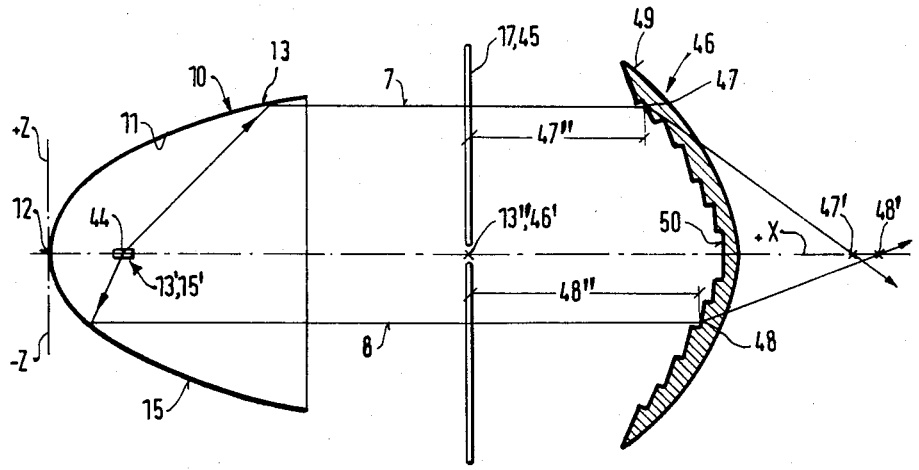
FIG. 4 shows diagramatically in horizontal section a headlight for greater horizontal spreading of the light beam.

FIG. 4 shows the horizontal median section, with the reflector 10, the reflection surface 11 and the vertex 12 in the case of a headlight for stopped down of dimmed light. The horizontal median section 15 is a parabola of which the focus 15' lies on the X-axis of the coordinate system and is approximately identical (coincident) with the vertex—adjacent focus 13' of the vertical median section that produces an ellipse. The incandescent helix 44 in this case is in the form of an axial helix and passes through the common focus 13'/15'.

The convergent lens is constituted as a bowed Fresnel lens 46 with several circular steps providing annular zones concentric with the X-axis, of which two zones 47 and 48 are shown in the drawing. All zones 47 and 48 have a common focus 46' on the reflector side of the lens, this focus being identical with the second focus 13'', the one more remote from the vertex, of the ellipse 13. The focal lengths 47'' and 48'', with reference to the radial extent of the Fresnel lens 46 are of different magnitude, as shown they decrease towards the edge 49. The foci 47' and 48' facing away from the reflector 10 of the lens 46 lie at different places on the X-axis. The optically effective edge of the diaphragm 17 lies slightly below the common focus 13'/46'. The focal rays 7 and 8 are incident parallel to the X-axis on the zones 47 and 48 respectively and are refracted to the respective foci 47' and 48'. Since the foci of all zones on the side of the lens 46 away from the reflector 10 lie closer to the lens 46 than the focus, not shown in the drawing, of the mid-region 50, the projected light beam has a relatively large horizontal divergence for the stopped down light.

Figure 5:
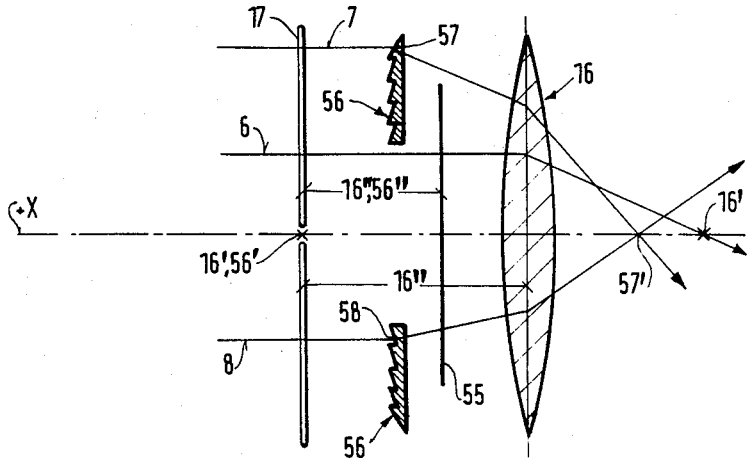
FIG. 5 shows a modification of the headlight of FIG. 4.

Approximately the same effect as in the case of the headlight of FIG. 4 is shown in the modification of FIG. 5, with the difference that an annular supplemental converging lens 56 constituted as a Fresnel lens is interposed between the mirror and the biconvex converging lens 16. The supplementary converging lens 56 essentially acts on the rays of the outer portion of the light beam and forms a system together with the converging lens 16 that has a common focus 16'/56', which falls at the same place as the focus 16' of the lens 16. This focus can also go inside with the outer focus 13' (FIG. 4) of the ellipse 13. The combined system has the focal plane 55 and the focal length 16/56'', while the focal length of the lens 16 is designated 16''.

The two rays 7 and 8 that run parallel to the axis are refracted towards the X-axis by the zones 57 and 58 and are then deflected by the lens 16 to the focus 57'. The ray 6 that is unaffected by the supplementary lens 56 is refracted by the lens 16 to its focus 16', which is the one farther removed from the reflector and has a greater spacing from the lens 16 than the focus 57'.

The supplementary converging lens can also be made of two lateral sectors or of two lateral circular surface sections in which case the two sectors or sections are arranged in mirror symmetry with respect to the vertical median plane.

The supplementary converging lens can also be constituted as a Fresnel lens.

Figure 6:
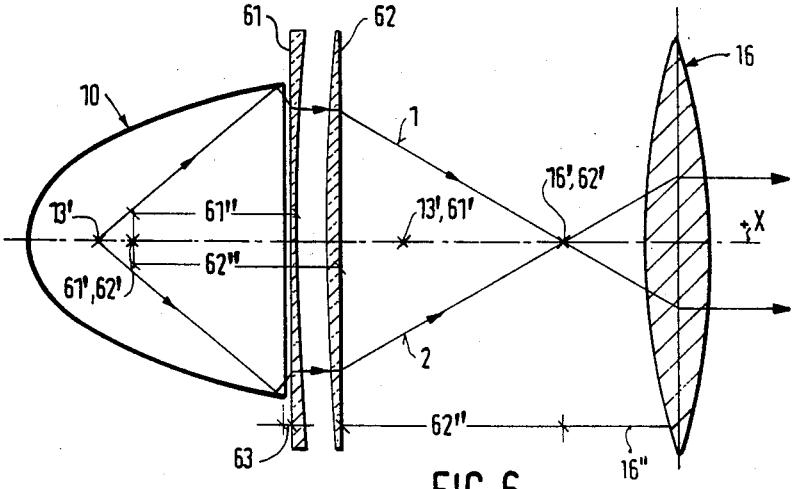
FIGS. 6 and 7 respectively show the vertical section and the horizontal section of a headlight for producing a light beam with a large width-to-height ratio.
Figure 7:
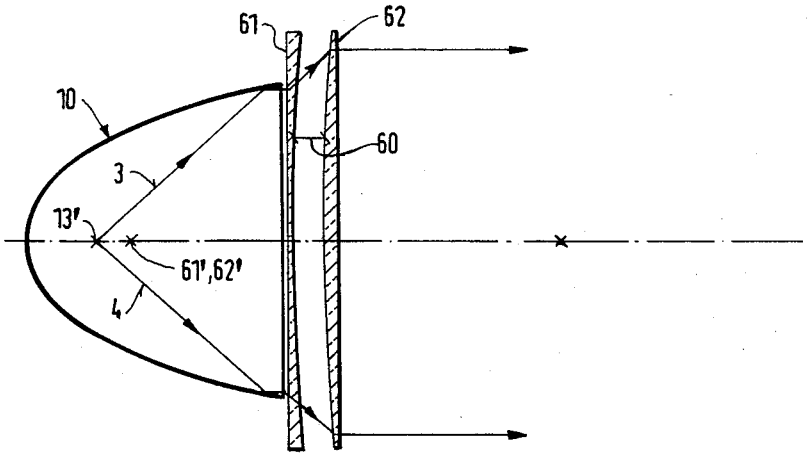

FIG. 6 shows, in vertical section, and FIG. 7 in horizontal section a headlight in which a system composed of a dispersing lens 61 and a supplementary converging lens 62 is interposed between the reflector 10 and the converging lens 16. In this case the focus 62', near the reflector, of the supplementary converging lens 62 coincides with the focus 61' of the dispersing lens 61; the focus 62', away from the reflector, of the supplementary converging lens 62 and one focus of the converging lens 16 are likewise coincident (or else lie close to each other); moreover, there is also coincidence of the focus 13', farther from the reflector, of the elliptical profile of the reflector 10 and the corresponding focus 61' of the dispersing lens 61. Finally, the focal length 16'' of the converging lens 16 is smaller than the focal length 62'' of the supplemental lens 62.

The edge rays 1 and 2, both lying in the vertical median plane, make clear that the light beam that is projected is smaller in its height of the reflector aperture and that both of the edge rays 3 and 4 lying in the horizontal median plane show that the width of the projected light beam is greater than the width of the reflector aperture. The spacing 63 between the dispersion lens 61 and the reflector 10 determines the height of the projected light beam and the spacing 60 between the supplementary converging lens 62 and the dispersing lens 61 determines the width of the projected light beam.

Figure 8:
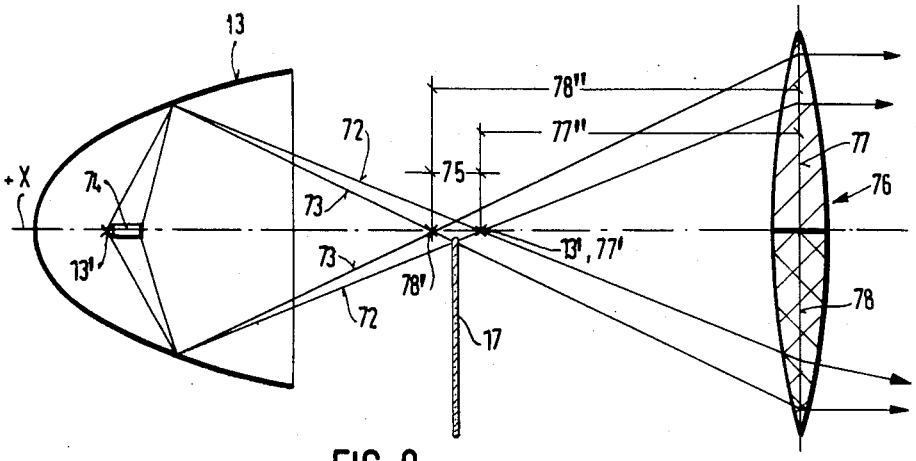
FIG. 8 shows a headlight for stopped down light in which light that would normally be screened off by the diaphragm is utilized for illumination below the light-/dark boundary.

The vertical section through a stopped down headlight of FIG. 8 shows the incandescent helix 74 which is defocused, in the direction of radiation, in front of the focus 13' of the ellipse 13. The lens 76 consists of an upper half 77 with the focus 77' and the focal length 77'' and of a lower half 78 having the focus 78' and the focal length 78''. The focal length 78'' is greater than the focal length 77'' by the amount 75, by which the two boundary rays 72 and 73 are separated from each other along the X-axis where they go out from the end of the incandescent helix 74. The focus 77' of upper lens half 77 is coincident with the focus 13', remote from the reflector, of the ellipse 13.

Figure 9:
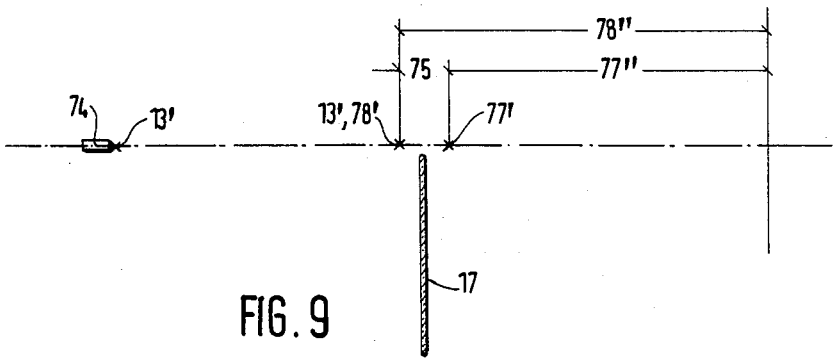
FIG. 9 is a partial view of a modification of the headlight of FIG. 8.

FIG. 9 shows the modification of the headlight of FIG. 8 in which the incandescent helix 74, instead of displaced in the direction of light projection, is defocused by displacement in the opposite direction, i.e. the focus 13' lies in front of the incandescent helix 74. The focus 13' of the ellipse 13, which is the focus of the latter which is the more remote from the reflector and the focus 78' of the lower lens half 78 coincide. Both kinds of defocusing of the incandescent helix 74 provide a downwardly directed light beam which is not dazzling to oncoming traffic.

Although the invention has been described with reference to particular illustrative examples, further variations and modifications are possible within the inventive concept. Thus, for example, instead of being parabolic, the curve produced by intersection of the reflector surface 11 with the horizontal mid-plane 20 may be part of another conic section curve, for example an ellipse or a hyperbola similar to the optimum parabola. Furthermore, the reflector may advantageously consist of two sectors respectively of two different horizontally parabolic and vertically elliptical surfaces or of three portions, two of them being different parabolic-elliptical surfaces and the third, between them, being an ellipsoidal surface.

We claim:

1. Headlight for a motor vehicle having a filamentary light source and a reflector, wherein;

the section of the reflector by the vertical median plane thereof is a part of an ellipse and contains a reflector axis which intersects the reflector at the reflector vertex;

sections of the reflector by planes which intersect the axis of the reflector at right angles are ellipses of which the half-axes are perpendicular to the reflector axis and one of them lies in said vertical median plane;

said filamentary light source is located at that one of the foci of said vertical median plane section ellipse which is the nearer to said reflector vertex;

a condensing lens is disposed with its axis on the reflector axis and with its focus towards the reflector coincident with the focus of said ellipse which is the farther from said reflector vertex;

a diaphragm located in the region of the reflector axis is disposed in the focal plane of said condensing lens nearer said reflector; and the optically effective edge of said diaphragm lies in the neighborhood of said focus of said lens towards said reflector, the section of the reflector by the horizontal median plane thereof being parabolic, different radial zones of said condensing lens respectively having different focal lengths, diminishing in magnitude toward the lens rim, while all said zones have a common focus which is said focus coincident with said reflector focus farther from said reflector vertex, said condensing lens being constituted as a meniscal Fresnel lens having a convex surface facing away from said reflector and a stepped concave surface facing towards said reflector.

2. Headlight according to claim 1 in which optical light scattering means are provided in the region of the horizontal midsection of said condensing lens constituted in such a way as to provide greater scattering of light in directions suitable for illumination of the road edges in front of the vehicle.

3. Headlight according to claim 2 in which said light scattering means are cylindrical lenses.

4. Headlight for a motor vehicle having a filamentary light source and a reflector, wherein:

the section of the reflector by the vertical median plane thereof is a part of an ellipse and contains a reflector axis which intersects the reflector at the reflector vertex;

sections of the reflector by planes which intersect the axis of the reflector at right angles are ellipses of which the half-axes are perpendicular to the reflector axis and one of them lies in said vertical median plane;

said filamentary light source is located at that one of the foci of said vertical median plane section ellipse which is the nearer to said reflector vertex;

a condensing lens is disposed with on its axis on the reflector axis and with its focus towards the reflector coincident with the focus of said ellipse which is the farther from said reflector vertex;

a diaphragm located in the region of the reflector axis is disposed in the focal plane of said condensing lens nearer said reflector; and the optically effective edge of said diaphragm lies in the neighborhood of said focus of said lens towards said reflector, the section of the reflector by the horizontal median plane thereof being parabolic, an optical system being disposed between said reflector and said condensing lens (16) which system is composed of a dispersing lens (61) and a supplementary condensing lens (62), the focus (62') of said supplementary condensing lens (62) and the focus (61') of said dispersing lens (61) nearer said reflector being coincident, the focus of said supplementary converging lens (62') farther from said reflector and a focus (16') of said first-mentioned condensing lens (16) being at least approximately coindicent, and the focus (13') of said ellipse (13) farther from said reflector and the focus (61') of said disbursing lens (61) farther from said reflector being coincident.

5. Headlight according to claim 4 in which the focal length (16'') of said first-mentioned condensing lens (16) is smaller than the focal length (62'') of said supplementary condensing lens (62).

6. Headlight according to claim 4 in which the spacing (63) between said dispersing lens (61) and said reflector (10) by the amount by which the two marginal rays (72,73) from the respective ends of said filamentary light source (74) are separated from each other along said reflector axis between their respective intersections with said reflector axis.

7. Headlight according to claim 4 in which optical light scattering means are provided in the region of the horizontal midsection of said condensing lens constituted in such a way as to provide greater scattering of light in direction suitable for illumination of the road edges in front of the vehicle.

8. Headlight according to claim 7 in which light scattering means are cylindrical lenses.

9. Headlight for a motor vehicle having a filamentary light source and a reflector, wherein:

the section of the reflector by the vertical median plane thereof is a part of an ellipse and contains a reflector axis which intersects the reflector at the reflector vertex;

sections of the reflector by planes which intersect the axis of the reflector at right angles are ellipses of which the half-axes are perpendicular to the reflector axis and one of them lies in said vertical median plane;

said filamentary light source is located at that one of the foci of said vertical median plane section ellipse which is the nearer to said reflector vertex;

a condensing lens is disposed with on its axis on the reflector axis and with its focus towards the reflector coincident with the focus of said ellipse which is the farther from said reflector vertex;

a diaphragm located in the region of the reflector axis is disposed in the focal plane of said condensing lens nearer said reflector; and the optically effective edge of said diaphragm lies in the neighborhood of said focus of said lens towards said reflector, the section of the reflector by the horizontal median plane thereof being parabolic, said condensing lens being composed of an upper lens half (77) and a lower lens half (78), the focal length (78'') of said lower lens half (78) being greater than the focal length (77'') of said upper lens half (77) determines the height of the projected light beam and the spacing (60) between said supplementary condensing lens (62) and said dispersing lens (61) determines the width of the projected light beam.

10. Headlight according to claim 9 in which optical light scattering means are provided in the region of the horizontal midsection of said condensing lens constituted in such a way as to provide greater scattering of light in direction suitable for illumination of the road edges in front of the vehicle.

11. Headlight according to claim 10 in which light scattering means are cylindrical lenses.

* * * * *